US012486847B2

(12) United States Patent
Nakano et al.

(10) Patent No.: US 12,486,847 B2
(45) Date of Patent: Dec. 2, 2025

(54) ELECTRIC PUMP

(71) Applicant: SHINANO KENSHI CO., LTD., Ueda (JP)

(72) Inventors: Takuya Nakano, Nagano (JP); Norihiro Sudo, Nagano (JP); Akihiro Takeda, Nagano (JP); Yuki Sakyu, Nagano (JP)

(73) Assignee: SHINANO KENSHI CO., LTD., Ueda (JP)

( * ) Notice: Subject to any disclaimer, the term of this patent is extended or adjusted under 35 U.S.C. 154(b) by 51 days.

(21) Appl. No.: 18/584,554

(22) Filed: Feb. 22, 2024

(65) Prior Publication Data

US 2024/0280106 A1 Aug. 22, 2024

(30) Foreign Application Priority Data

Feb. 22, 2023 (JP) ..... 2023-026318

(51) Int. Cl.
*F04D 29/18* (2006.01)
*F04C 29/00* (2006.01)
(Continued)

(52) U.S. Cl.
CPC ..... *F04C 29/0064* (2013.01); *F04D 29/08* (2013.01); *F04D 29/18* (2013.01);
(Continued)

(58) Field of Classification Search
CPC .... F04C 2/3445; F04C 15/06; F04C 29/0064; F04C 2250/30; F04D 25/0633; F04D 25/0646
See application file for complete search history.

(56) References Cited

U.S. PATENT DOCUMENTS 3,975,117 A 8/1976 Carter
2008/0075586 A1* 3/2008 Fukuki ..... F04D 1/063 415/177
(Continued)

FOREIGN PATENT DOCUMENTS

CN 111486107 A 8/2020
CN 111486108 A 8/2020
(Continued)

OTHER PUBLICATIONS

Machine translation of EP 1091472 A2, accessed Jun. 10, 2025. (Year: 2025).*
(Continued)

*Primary Examiner* — Jonathan R Matthias
(74) *Attorney, Agent, or Firm* — Oliff PLC

(57) ABSTRACT

An electric pump includes a case, and a motor that includes a rotor and a stator and is surrounded by the case. The case includes an introduction pipe portion for introducing a fluid and a discharge pipe portion for discharging the fluid. The rotor is disposed in a space surrounded by the case and the stator and communicating with the introduction pipe portion and the discharge pipe portion. The rotor includes a first blade member, a second blade member, and a relay portion. An outer diameter of the relay portion is smaller than an outer diameter of at least one of the first and second blade members. The relay portion is positioned between the first blade member and the second blade member.

6 Claims, 8 Drawing Sheets

(51) Int. Cl.
*F04D 29/08* (2006.01)
*F04D 29/40* (2006.01)

(52) U.S. Cl.
CPC ..... *F04D 29/40* (2013.01); *F04C 2240/20* (2013.01); *F04C 2240/40* (2013.01)

(56) References Cited

U.S. PATENT DOCUMENTS

| | | | | |
|---|---|---|---|---|
| 2011/0200469 | A1 | 8/2011 | Kawabata et al. | |
| 2020/0229660 | A1 * | 7/2020 | Tsuchida | F04D 25/082 |
| 2020/0300261 | A1 | 9/2020 | Umematsu | |

FOREIGN PATENT DOCUMENTS

| | | | | |
|---|---|---|---|---|
| CN | 111486109 | A | 8/2020 | |
| CN | 111486110 | A | 8/2020 | |
| EP | 1091472 | A2 * | 4/2001 | F04D 5/002 |
| JP | 2002-064956 | A | 2/2002 | |
| JP | 2011-163494 | A | 8/2011 | |
| JP | 2020-153331 | A | 9/2020 | |
| WO | 2018/193530 | A1 | 10/2018 | |
| WO | WO-2023038049 | A1 * | 3/2023 | E03B 3/04 |

OTHER PUBLICATIONS

Machine translation of WO 2023/038049 A1, accessed Jun. 10, 2025. (Year: 2025).*

Oct. 22, 2024 Office Action issued in Japanese Patent Application No. 2023-026318.

"A3.3 Thrust Balance". Manufacturing in Japan, <URL: https://monozukuri.sqcd-aid.com/%E6%97%A5%E6%9C %AC%E3%81%AE%E5%9B%BD%E3%81%A7%E3%82%82%E3%81%AE%E3%81%A5%E3%81%8F%E3%82%8A%E3%80%81%E3%81%B2%E3%81%A8%E3%81%A5%E3%81%8F%E3%82%8A%E3%82%92%E8%A1%8C%E3%81%84%E3%81%BE%E3%81%97%E3%82%87/index-of-applicati on/introduction-to-incompressible-liquid-machinery/a3-3-t hrust-balance/>.

* cited by examiner

ELECTRIC PUMP

CROSS-REFERENCE TO RELATED APPLICATION

This application is based upon and claims the benefit of priority of the prior Japanese Patent Application No. 2023-026318, filed on Feb. 22, 2023, the entire contents of which are incorporated herein by reference.

BACKGROUND

(i) Technical Field

The present disclosure relates to an electric pump.

(ii) Related Art

There is an electric pump including a blade member in which blades are provided on both a front surface and a rear surface in order to suppress excessive load on one side in an axial direction of a rotor (for example, refer to Japanese Unexamined Patent Application Publication No. 2020-153331).

Loads act on the front side and the rear side of the blade member, which might cause warping of the blade member. In order to suppress such warpage, it is conceivable to form the blade member thick. However, if the thickness of the blade member is large, the electric pump might be increased in size in an axial direction. Further, when the blades are provided on both the front side and the back side of the blade member by using a resin, molding defects might occur. Further, a mold for this purpose might be also complicated. This might increase a manufacturing cost.

SUMMARY

According to an aspect of the present disclosure, there is provided a an electric pump including a case; and a motor that includes a rotor and a stator and is surrounded by the case, wherein the case includes an introduction pipe portion for introducing a fluid and a discharge pipe portion for discharging the fluid, the rotor is disposed in a space surrounded by the case and the stator and communicating with the introduction pipe portion and the discharge pipe portion, the rotor includes a first blade member, a second blade member, and a relay portion, an outer diameter of the relay portion is smaller than an outer diameter of at least one of the first and second blade members, and the relay portion is positioned between the first blade member and the second blade member.

DETAILED DESCRIPTION

[Schematic Configuration of Electric Pump]

Figure 1:
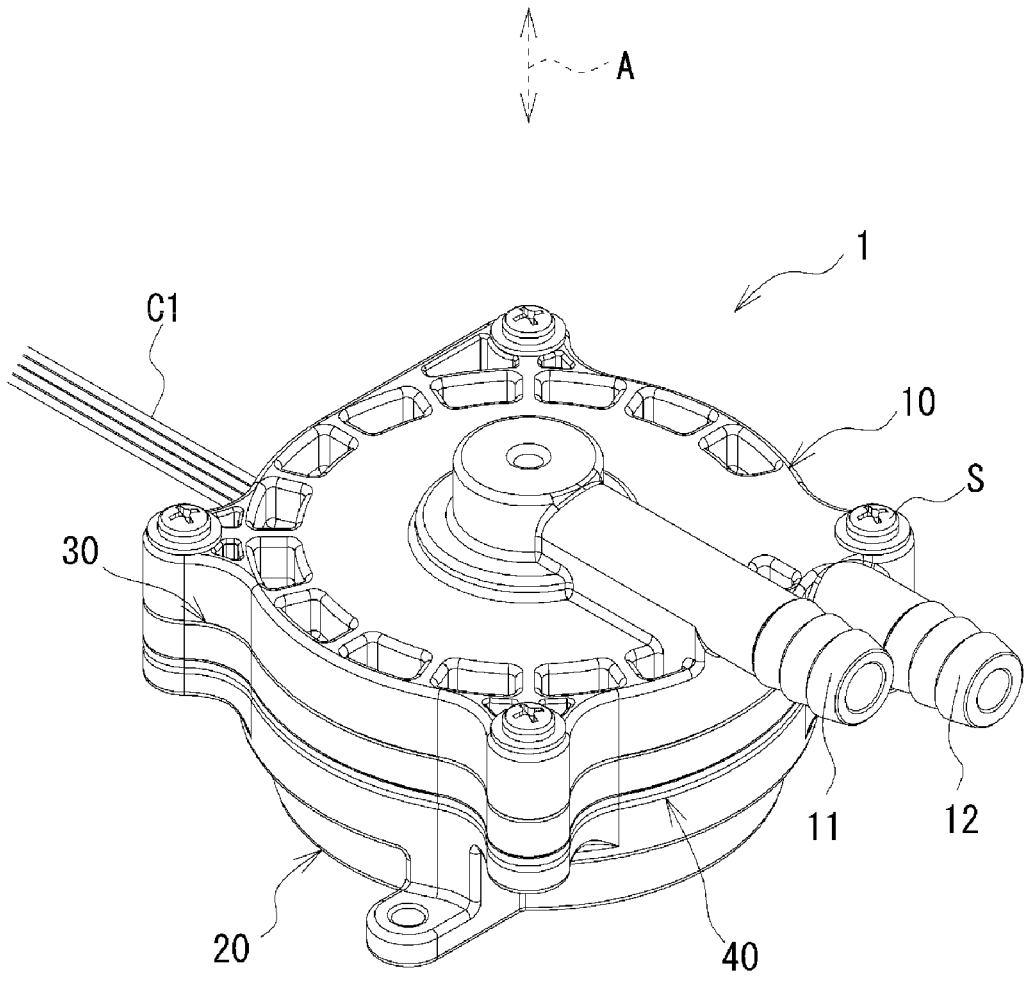
FIG. 1 is an external perspective view of an electric pump.
Figure 2:
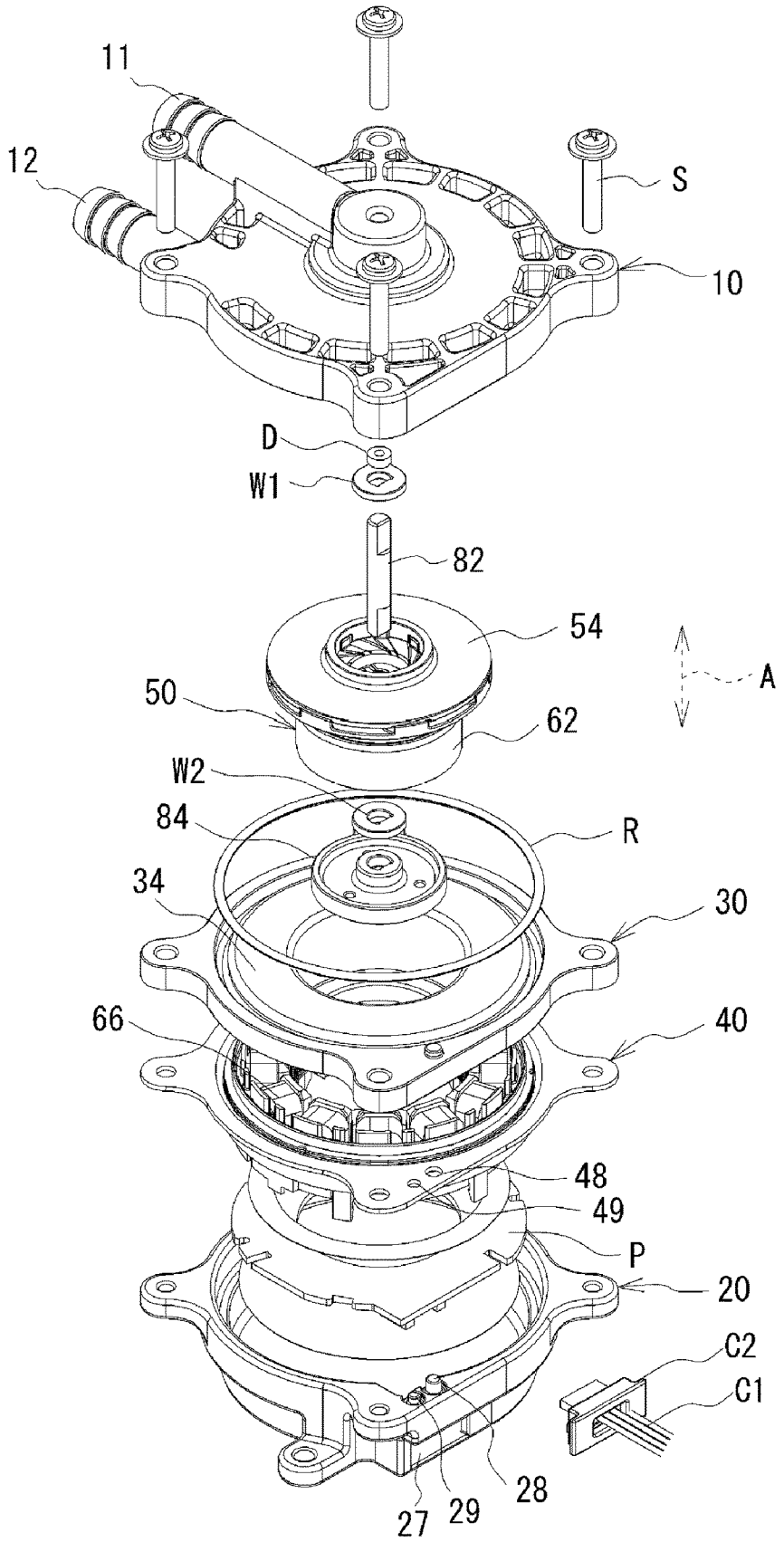
FIG. 2 is an exploded perspective view of the electric pump.
Figure 3:
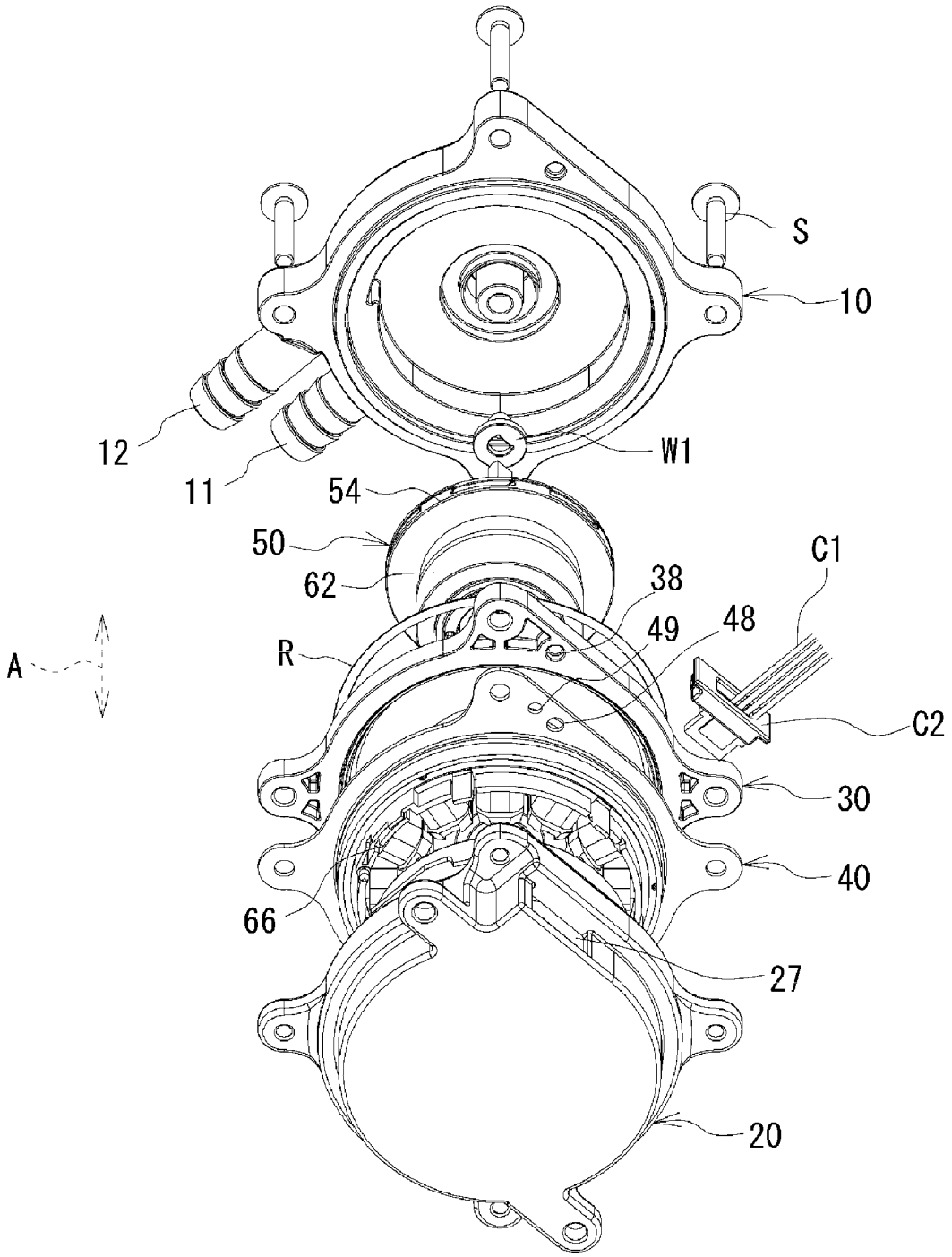
FIG. 3 is an exploded perspective view of the electric pump.

FIG. 1 is an external perspective view of an electric pump 1. FIGS. 2 and 3 are exploded perspective views of the electric pump 1. The electric pump 1 includes a first case 10, a cover 20, a second case 30, a support member 40, and a rotor 50. The first case 10, the cover 20, the second case 30, and the support member 40 are fixed by a plurality of screws S in a state of being overlapped in an axial direction A of the motor M described later.

The first case 10 and the second case 30 are made of resin. The cover 20 and the support member 40 are made of metal. The cover 20 is made of, for example, aluminum alloys. The support member 40 is made of, for example, stainless steel. The first case 10 and the second case 30 overlap each other in the axial direction A. The support member 40 is sandwiched between the second case 30 and the cover 20. The first case 10 and the second case 30 are examples of a first member and a second member, respectively.

The cover 20 is formed with positioning bosses 28 and 29. The support member 40 is formed with positioning holes 48 and 49. A positioning recess 38 is formed in the second case 30. The positioning boss 28 is fitted into the positioning hole 48 and the positioning recess 38, thereby defining the positions of the second case 30 and the support member 40 with respect to the cover 20. The positioning boss 29 is fitted into the positioning hole 49, whereby the position of the support member 40 with respect to the cover 20 is defined.

An introduction pipe portion 11 and a discharge pipe portion 12 are formed in the first case 10. The introduction pipe section 11 draws fluid into the interior of the electric pump 1. The discharge pipe portion 12 discharges the fluid from the electric pump 1. In the present embodiment, the fluid is a liquid, but may be a gas. A connector C2 attached to the end of a cable C1 is inserted into an opening 27 of the cover 20. Thus, the connector C2 is electrically connected to a printed board P, and electric power is supplied to the motor M described later.

Figure 4:
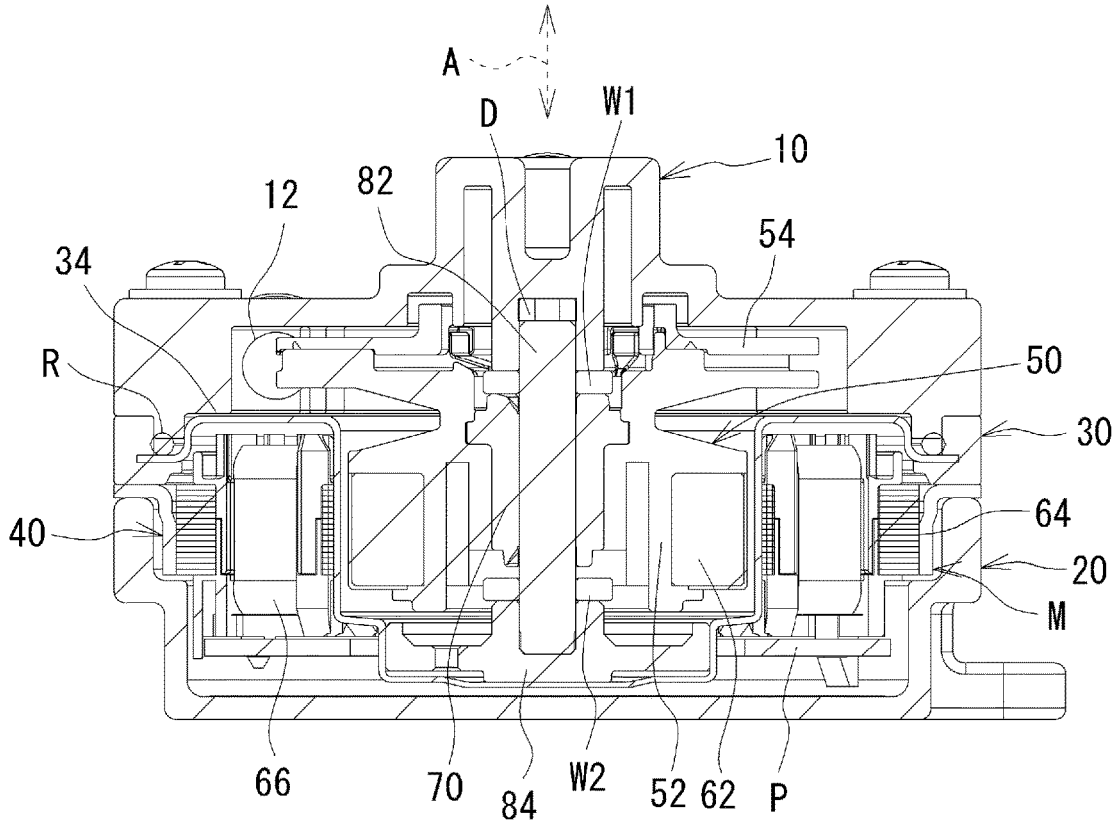
FIG. 4 is a sectional view of the electric pump.

FIG. 4 is a sectional view of the electric pump 1. The motor M is surrounded by the first case 10, the second case 30, and the cover 20. The motor M includes the rotor 50, a stator 64, coils 66, and a shaft member 82. The rotor 50 includes a holding portion 52, a magnet 62, and a sliding bearing 70. The magnet 62 is held at a position radially outside the holding portion 52. The holding portion 52 is made of resin. The magnet 62 has a cylindrical shape. The magnet 62 is magnetized to have different polarities in a circumferential direction. The sliding bearing 70 is held radially inside the holding portion 52. A blade member 54 is formed at one end of the holding portion 52. A blade member 57, which will be described in detail later, is formed at the other end of the holding portion 52. The stator 64 is disposed radially outside the magnet 62. A plurality of the coils 66 are wound around the stator 64. The stator 64 is supported by the support member 40 in a press-fitted state.

The second case 30 has an annular shape. A partition member 34 is attached to the inside of the second case 30. The partition member 34 is made of metal. The partition member 34 partitions the rotor 50 and the stator 64. The fluid introduced from the introduction pipe portion 11 is introduced into a space defined by the partition member 34 and the first case 10. A rubber O-ring R is disposed between the inner surface of the second case 30, the partition member 34, and the first case 10.

The shaft member 82 is inserted into the sliding bearing 70. A washer W1 is fitted at one end of the shaft member 82. The washer W1 is sandwiched between the first case 10 and the sliding bearing 70. The other end of the shaft member 82 is fixed to a support plate 84 via a washer W2. In this way, the shaft member 82 is fixed so as not to be rotatable. A rubber damper D is disposed between one end of the shaft member 82 and the first case 10. The support plate 84 is disposed at a bottom portion of the partition member 34.

When the plurality of coils 66 are energized, a magnetic force is generated between the stator 64 and the magnet 62. Thus, the rotor 50 rotates. In this way, the blade member 54 rotates.

The rotor 50 is disposed in a space surrounded by the first case 10 and the partition member 34 and communicating with the introduction pipe portion 11 and the discharge pipe portion 12. Thus, the rotor 50 rotates, and the fluid introduced into the space from the introduction pipe portion 11 is discharged from the discharge pipe portion 12.

[Detailed Configuration of Holding Portion 52]

Figure 5:
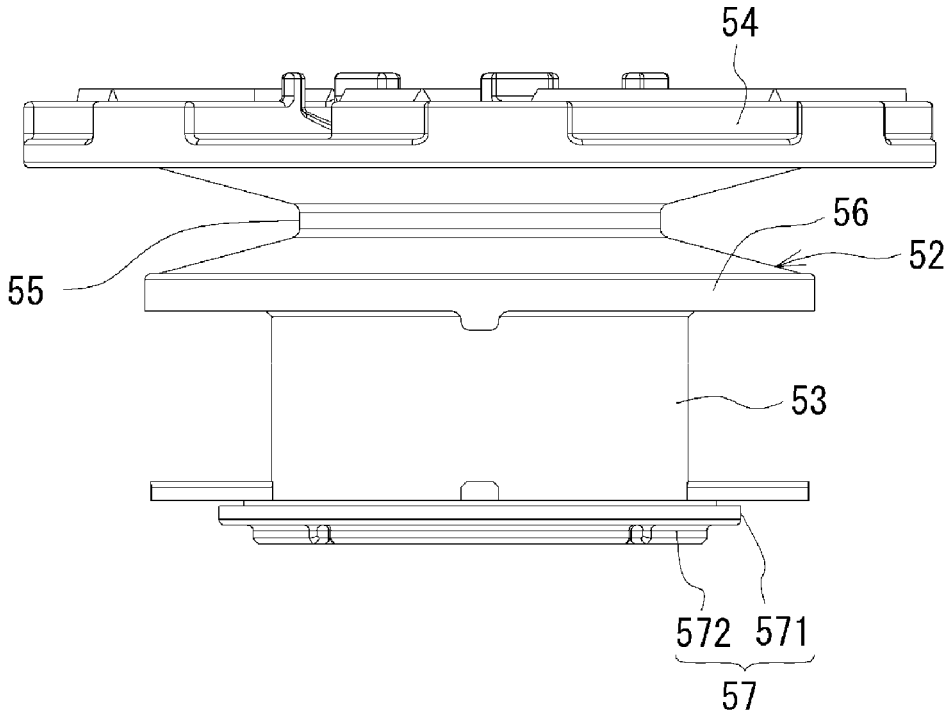
FIG. 5 is an external view of a holding portion.
Figure 6:
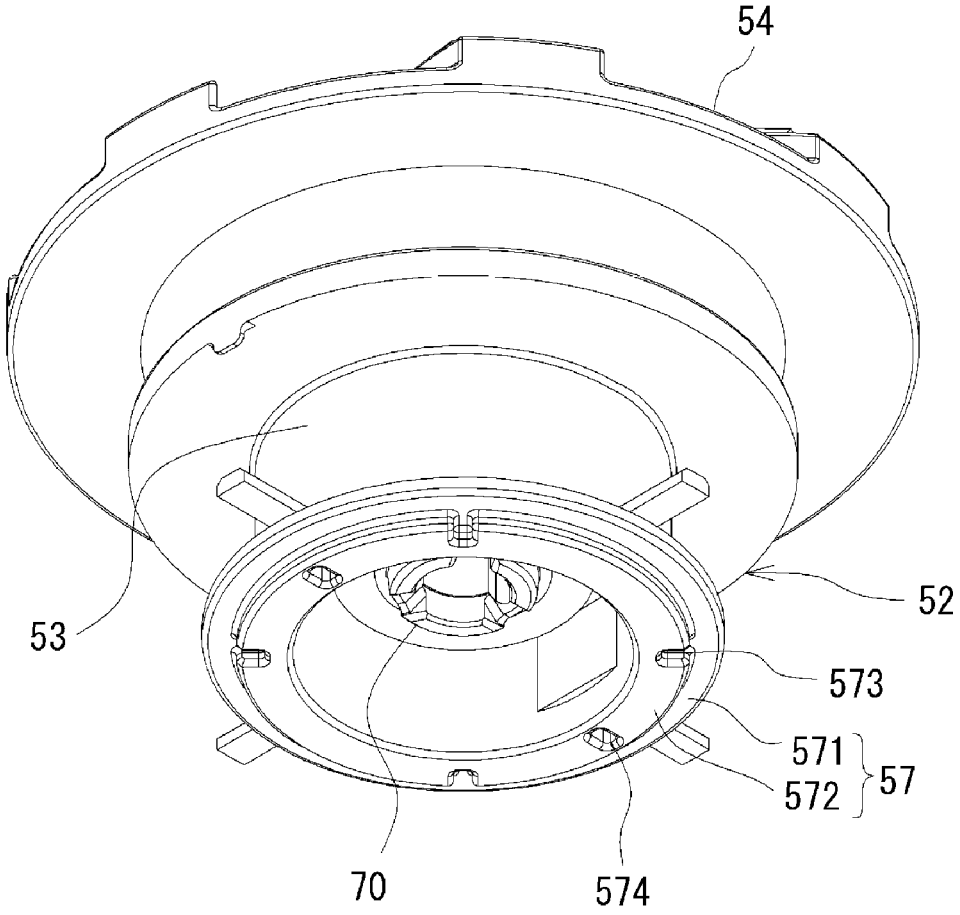
FIG. 6 is an external view of the holding portion.

FIGS. 5 and 6 are external views of the holding portion 52. In FIGS. 5 and 6, the magnet 62 is omitted. The holding portion 52 includes a cylindrical portion 53, a reduced diameter portion 55, a flange portion 56, and the blade member 57 in addition to the blade member 54. The blade member 54 is an example of a first blade member. The blade member 57 is an example of a second blade member. The cylindrical portion 53, the reduced diameter portion 55, and the flange portion 56 are positioned between the blade member 54 and the blade member 57. Each of the outer diameters of the cylindrical portion 53 and the reduced diameter portion 55 is smaller than each of the outer diameters of the blade members 54 and 57. The outer diameter of the flange portion 56 is smaller than that of the blade member 54. Therefore, the cylindrical portion 53, the reduced diameter portion 55, and the flange portion 56 are an example of a relay portion. The cylindrical portion 53 is positioned radially inward of the magnet 62. The cylindrical portion 53 has a cylindrical shape. The cylindrical portion 53 is fitted into the magnet 62. The reduced diameter portion 55 is positioned between the blade member 54 and the flange portion 56. The outer diameter of the reduced diameter portion 55 is smaller than each of the outer diameters of the blade member 54, the flange portion 56, the cylindrical portion 53, the magnet 62, and the blade member 57. The outer diameter of the flange portion 56 is larger than each of the outer diameters of the reduced diameter portion 55 and the cylindrical portion 53 and smaller than the outer diameter of the blade member 54. The outer diameter of the flange portion 56 is substantially the same as the outer diameter of the magnet 62.

The flange portion 56 and the blade member 57 sandwich the magnet 62 in the axial direction A. The blade member 54 is positioned on one side with respect to the magnet 62, and the blade member 57 is positioned on the other side with respect to the magnet 62. That is, the blade members 54 and 57 are separated from each other in the axial direction A. As illustrated in FIG. 4, the blade member 54 is surrounded by the first case 10. As illustrated in FIG. 4, the blade member 57 is surrounded by the stator 64 and the partition member 34. As illustrated in FIG. 6, the blade member 54 has a concave-convex blade formed on the front surface thereof, but has no blade formed on the rear surface thereof. Therefore, the shape of the blade member 54 is not complicated, and the holding portion 52 is easily manufactured. Therefore, the manufacturing cost is suppressed.

The blade member 57 includes a flange portion 571 and a blade portion 572. The flange portion 571 and the blade portion 572 are both annular. The outer diameter of the flange portion 571 is larger than the outer diameter of the blade portion 572. The blade portion 572 is formed on the flange portion 571. In the present embodiment, four grooves 573 are formed in the blade portion 572. The four grooves 573 are provided at equal angular intervals. That is, the four grooves 573 are provided at intervals of 90 degrees. The groove 573 extends linearly in the radial direction. The groove 573 extends from a position in the middle of the blade portion 572 in the radial direction to the outer peripheral edge of the blade portion 572. The width of the groove 573 perpendicular to the direction in which the groove 573 extends is constant in the radial direction. The depth of the groove 573 is constant in the radial direction. The blade portion 572 is formed with two recesses 574 for positioning the magnet 62 when the magnet 62 is magnetized.

Thus, the blade members 54 and 57 are integrally formed with the holding portion 52. Therefore, the excessive load on one side of the rotor 50 in the axial direction A is suppressed. Further, the thickness of each of the blade member 54 and the blade member 57 is reduced. Therefore, the electric pump 1 is downsized in the axial direction A.

The size of the blade member 57 in the radial direction does not depend on the size of the blade member 54 in the radial direction. Therefore, the degree of freedom in designing the blade member 57 is improved. In the present embodiment, the outer diameter of the blade member 57 is smaller than the outer diameter of the magnet 62. Therefore, it is possible to suppress the excessive force that the blade member 57 receives from the fluid.

The blade member 57 is not limited to being disposed so as to be surrounded by the partition member 34 as in the present embodiment. The blade member 57 may be disposed anywhere as long as the pressure of the fluid is high in the space surrounded by the first case 10 and the partition member 34.

[Variations of Blade Member]

Figure 7A:
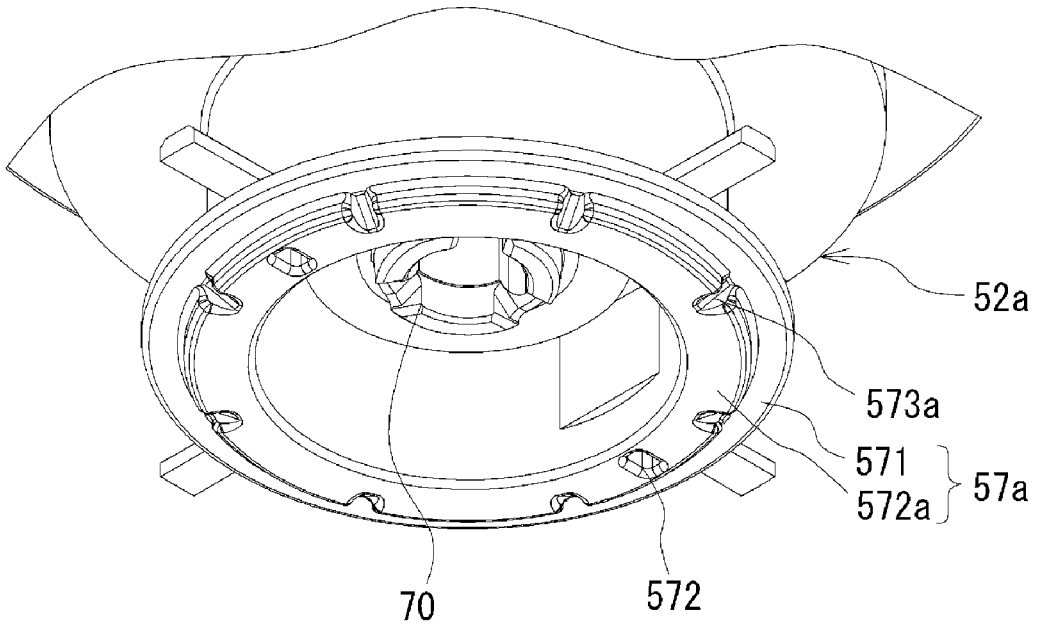
FIGS. 7A and 7B are explanatory views of variations of a blade member.

FIGS. 7A to 8B are explanatory views of variations of the blade members. The same reference numerals are given to the same components as those in the above-described embodiment, and the description thereof will be omitted. As illustrated in FIG. 7A, eight grooves 573*a* are provided in a blade portion 572*a* of a blade member 57*a* of a holding portion 52*a*. The eight grooves 573*a* are provided at equal angular intervals. That is, the eight grooves 573*a* are provided at intervals of 45 degrees. The depth of the groove 573*a* increases toward the radially outer side.

Figure 7B:
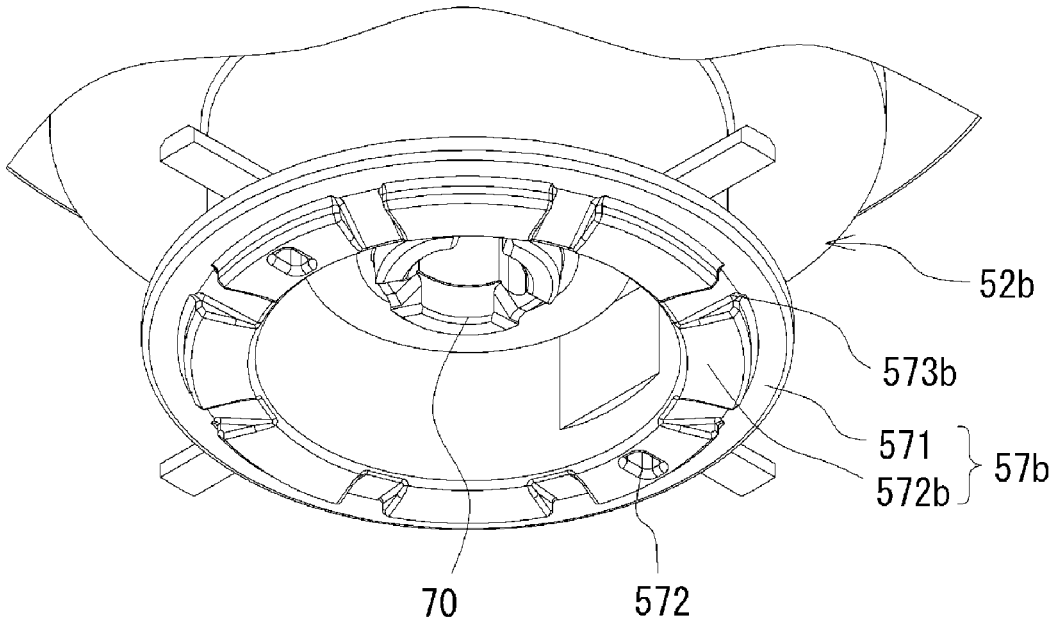

As illustrated in FIG. 7B, eight grooves 573*b* are provided in a blade portion 572*b* of a blade member 57*b* of a holding portion 52*b*. The groove 573*b* extends from an inner peripheral edge of the blade portion 572*b* to an outer peripheral edge of the blade portion 572*b*. The groove 573*b* is wider than each of the groove 573 and the groove 573*b* described above. The depth of the groove 573*b* is shallower than the depth of the groove 573 described above.

Figure 8A:
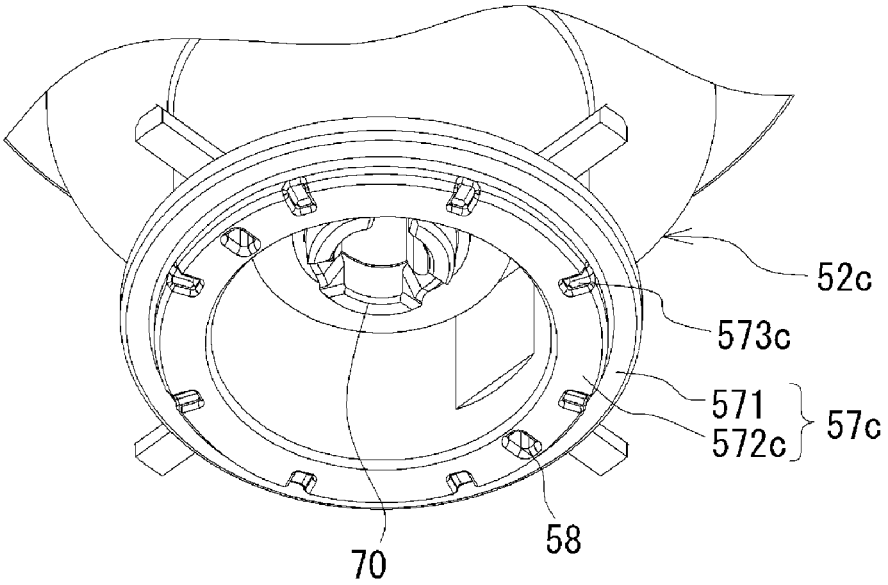
FIGS. 8A and 8B are explanatory views of variations of the blade member.

As illustrated in FIG. 8A, eight grooves 573*c* are provided in a blade portion 572*c* of a blade member 57*c* of a holding portion 52*c*. The depth of the groove 573*c* is shallower than the depth of the groove 573 described above.

Figure 8B:
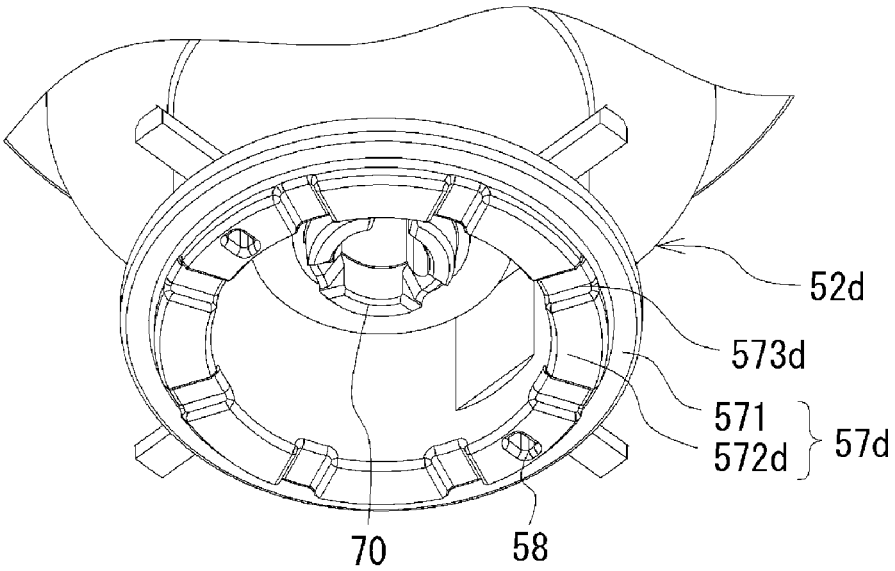

As illustrated in FIG. 8B, eight grooves 573*d* are provided in a blade portion 572*d* of a blade member 57*d* of a holding portion 52*d*. The groove 573*d* extends from an inner peripheral edge of the blade portion 572*d* to an outer peripheral edge of the blade portion 572*d*. The depth of the groove 573*d* increases toward the radially outer side.

The contents of the above embodiment is also be applied to an electric pump for introducing and discharging gas. That is, the electric pump includes a so-called electric blower that introduces and discharges gas.

While the exemplary embodiments of the present disclosure have been illustrated in detail, the present disclosure is not limited to the above-mentioned embodiments, and other embodiments, variations and variations may be made without departing from the scope of the present disclosure.

What is claimed is:

1. An electric pump comprising:

a case;

a motor that includes a rotor and a stator and is surrounded by the case; and a partition member that partitions the rotor and the stator, wherein the case includes an introduction pipe portion for introducing a fluid and a discharge pipe portion for discharging the fluid, the rotor is disposed in a space surrounded by the case, the stator, and the partition member and communicating with the introduction pipe portion and the discharge pipe portion, the rotor includes a first blade member, a second blade member, and a relay portion, an outer diameter of the relay portion is smaller than an outer diameter of at least one of the first and second blade members, the relay portion is positioned between the first blade member and the second blade member, each of the introduction pipe portion and the discharge pipe portion is located closer to the first blade member than to the second blade member, the space is sealed by the case and the partition member except at the introduction pipe portion and the discharge pipe portion, and the second blade member is surrounded by the partition member.

2. The electric pump according to claim 1, wherein the second blade member includes a plurality of grooves extending linearly in a radial direction.

3. The electric pump according to claim 2, wherein a width of the groove perpendicular to the radial direction is constant.

4. The electric pump according to claim 2, wherein the rotor includes a magnet, and an outer diameter of the second blade member is smaller than an outer diameter of the magnet.

5. The electric pump according to claim 1, wherein the first blade member is surrounded by the case, and the second blade member is surrounded by the stator.

6. The electric pump according to claim 1, wherein the rotor includes a magnet, the first blade member is located on one side with respect to the magnet, and the second blade member is located on the other side with respect to the magnet.

* * * * *